US008479873B2

(12) United States Patent
Dodd

(10) Patent No.: US 8,479,873 B2
(45) Date of Patent: Jul. 9, 2013

(54) LOUDSPEAKER

(75) Inventor: Mark Dodd, Woodbridge (GB)

(73) Assignee: GP Acoustics (UK) Limited, Kent (GB)

( * ) Notice: Subject to any disclaimer, the term of this patent is extended or adjusted under 35 U.S.C. 154(b) by 70 days.

(21) Appl. No.: 12/670,258

(22) PCT Filed: Jul. 14, 2008

(86) PCT No.: PCT/GB2008/002396

§ 371 (c)(1),
(2), (4) Date: Apr. 21, 2011

(87) PCT Pub. No.: WO2009/013460

PCT Pub. Date: Jan. 29, 2009

(65) Prior Publication Data

US 2011/0192674 A1 Aug. 11, 2011

(30) Foreign Application Priority Data

Jul. 25, 2007 (GB) ..... 0714474.4

(51) Int. Cl.
*G10K 11/00* (2006.01)

(52) U.S. Cl.
USPC ..... 181/177; 381/340; 381/342

(58) Field of Classification Search
USPC ..... 181/30, 175, 176, 177, 192; 381/339, 381/340, 342, 161
See application file for complete search history.

(56) References Cited

U.S. PATENT DOCUMENTS

| | | | | | |
|---|---|---|---|---|---|
| 2,127,110 | A | * | 8/1938 | Farrand | 381/342 |
| 2,537,141 | A | * | 1/1951 | Klipsch | 181/187 |
| 4,071,112 | A | * | 1/1978 | Keele, Jr. | 181/187 |
| 4,308,932 | A | * | 1/1982 | Keele, Jr. | 181/187 |
| 4,381,831 | A | * | 5/1983 | Putnam | 181/152 |
| 4,390,078 | A | * | 6/1983 | Howze et al. | 181/185 |
| 5,285,025 | A | * | 2/1994 | Yoshioka | 181/192 |
| 5,750,943 | A | * | 5/1998 | Heinz | 181/152 |
| 5,900,593 | A | | 5/1999 | Adamson | |
| 5,925,856 | A | * | 7/1999 | Meyer et al. | 181/152 |
| 6,059,069 | A | * | 5/2000 | Hughes, II | 181/152 |
| 6,170,603 | B1 | | 1/2001 | Bachmann | |
| 6,393,131 | B1 | * | 5/2002 | Rexroat | 381/342 |
| 6,466,680 | B1 | * | 10/2002 | Gelow et al. | 381/340 |
| 6,658,128 | B1 | * | 12/2003 | Yoshioka et al. | 381/340 |
| 6,712,177 | B2 | * | 3/2004 | Ureda | 181/152 |

(Continued)

FOREIGN PATENT DOCUMENTS

| | | |
|---|---|---|
| EP | 0680242 A1 | 11/1995 |
| EP | 1571876 A1 | 7/2005 |

(Continued)

OTHER PUBLICATIONS

European Office Action; 08775937.9; Jul. 19, 2012.

(Continued)

*Primary Examiner* — Jeremy Luks
(74) *Attorney, Agent, or Firm* — Westman, Champlin & Kelly, P.A.; Z. Peter Sawicki

(57) ABSTRACT

A loudspeaker comprising a horn waveguide having a throat and a waveguide surface; an acoustic radiator assembly, located at the throat of the waveguide, comprising a diaphragm having a rigid acoustically radiating surface shaped as a section from a toroidal surface for generating acoustic wavefronts, the waveguide surface being adapted to match the shape of the wavefronts coming from the assembly.

20 Claims, 6 Drawing Sheets

U.S. PATENT DOCUMENTS

| | | | | |
|---|---|---|---|---|
| 2004/0240697 | A1* | 12/2004 | Keele, Jr. | 381/336 |
| 2006/0153407 | A1* | 7/2006 | Keele et al. | 381/182 |
| 2006/0153420 | A1* | 7/2006 | Takase et al. | 381/424 |

FOREIGN PATENT DOCUMENTS

| | | | |
|---|---|---|---|
| GB | 754901 | | 8/1956 |
| GB | 2211377 | A | 6/1989 |
| GB | 2423908 | A | 9/2006 |
| WO | 9853638 | | 11/1998 |
| WO | 2006092609 | A1 | 9/2006 |

OTHER PUBLICATIONS

International Search Report, Mar. 9, 2009.
Written Opinion, Mar. 9, 2009.

* cited by examiner

Fig.7(a)
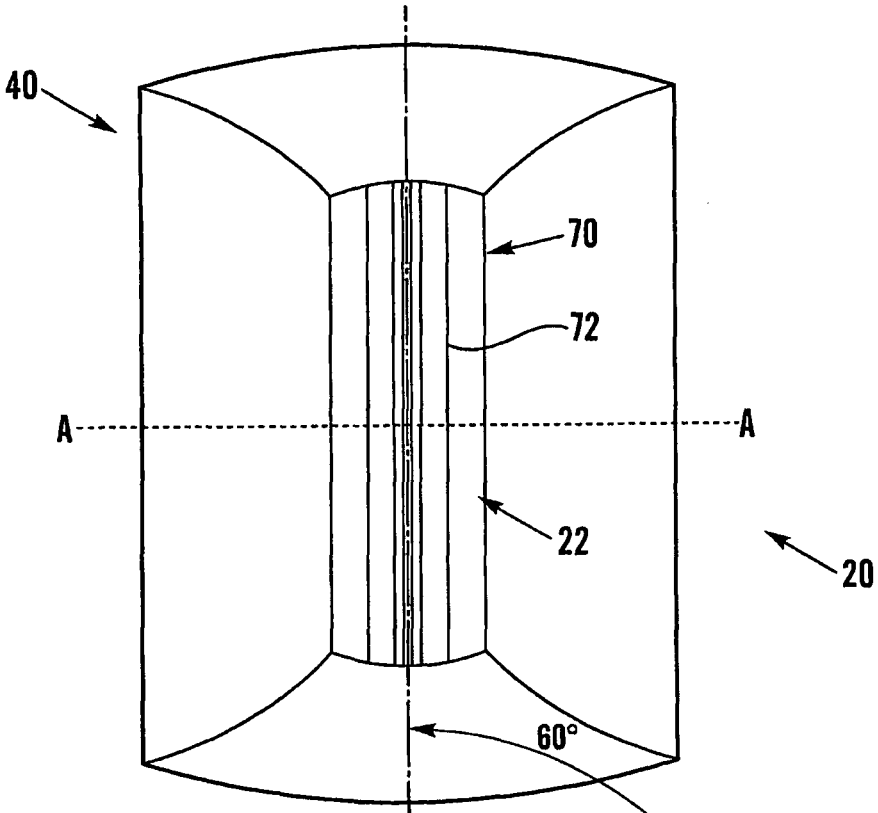
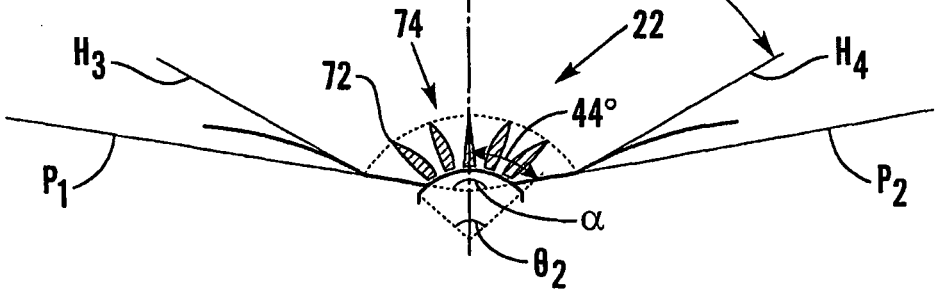
Fig.7(b)

LOUDSPEAKER

CROSS-REFERENCE TO RELATED APPLICATION

This Application is a Section 371 National Stage Application of International Application No. PCT/EP2008/002396, filed Jul. 14, 2008 and published as WO 2009/013460 A2 on Jan. 29, 2009, the content of which is hereby incorporated by reference in its entirety.

FIELD OF THE INVENTION

The present invention relates generally to a loudspeaker and an acoustic radiator assembly for a loudspeaker.

BACKGROUND OF THE INVENTION

In acoustics, loudspeaker designers are always striving to produce loudspeakers with an acoustic radiation pattern with as much directional uniformity and as smooth a pressure response as possible.

WO 2006/092609 discloses how a dome-shaped diaphragm generating a spherical wavefront and a conical wave guide of limited angle can be arranged to produce a loudspeaker having conical dispersion characteristics with an exceptionally smooth pressure response.

There are occasions when it is desirable for a loudspeaker to produce a non axi-symmetric acoustic radiation pattern. For example, in an auditorium it may be desirable for the acoustic wavefronts to have different curvatures in the horizontal and vertical directions. In the prior art one technique for achieving this is to use horns which, by means of diffraction slots, forcibly shape the wavefronts to achieve the desired acoustic radiation pattern.

SUMMARY OF THE INVENTION

The present invention is based on the inventors' realisation that loudspeaker designers, in trying to achieve an acoustic radiation pattern with as much directional uniformity and as smooth a pressure response as possible, ought to be seeking to replicate, in practice, as closely as possible one of an idealised plane, cylindrical or spherical sound source. These theoretical sound sources give rise, according to the Helmholtz wave equation, to very simple travelling waves which can be described as a function of a single spatial parameter and thus have no directional irregularities.

With this realisation in mind, the present invention stemmed from the recognition that a ring of point sources circumscribing an infinitely long rigid cylinder could be expected to give rise to wavefronts which are toroidal in shape, and, accordingly, have different curvatures in different directions. Finite element models have shown such boundary conditions do indeed result in an approximately toroidal wavefront with little amplitude variation across the wavefront. In an appropriate coordinate system the wave may be approximately described as a function of a single spatial parameter.

Accordingly, according to a first aspect of the invention, the present invention may provide a loudspeaker comprising a horn waveguide having a throat and a waveguide surface; an acoustic radiator assembly, located at the throat of the waveguide, comprising a diaphragm having a rigid acoustically radiating surface shaped as a section from a toroidal surface for generating acoustic wavefronts, the waveguide surface being adapted to match the shape of the wavefronts coming from the assembly.

Thus, the present invention by using an acoustic radiator assembly with a diaphragm having an acoustically radiating surface shaped as a section from a toroidal surface is able to directly generate a radiation pattern having wavefronts with different curvatures in two orthogonal (e.g. x and y) directions and have good directional regularity.

A torus is a surface of revolution generated by revolving a circle in three dimensions about an axis of rotation coplanar with the circle. Thus, a surface of a section cut from the torus may be thought of as having two defining curvatures, a first curvature in a plane perpendicular to the axis of rotation of the torus, and a second curvature in a second plane co-planar with the axis of rotation. Also, the extent of the surface of the section cut from the torus may be thought of as having two defining angles, a first section angle in a plane perpendicular to the axis of rotation of the torus, and a second section angle in a second plane co-planar with the axis of rotation.

Preferably, the section has a first section angle and a first curvature in a first plane perpendicular to the axis of rotation of a torus extrapolated from the toroidal surface and a second section angle and a second curvature in a second plane co-planar with said axis of rotation, wherein the first curvature and the second curvature differ.

In order to preserve the shape of the wavefronts as they travel from the acoustic radiator assembly, the shape of the waveguide surface must be matched to that of the wavefronts in order not to disrupt the regularity of the radiation pattern. Matching occurs if the angle between the direction of travel of the wavefronts coming from the acoustic radiator assembly and a tangent to a nearby portion of the waveguide surface is approximately 90°.

Accordingly, it is preferred that horn wave guide is dual angle comprising a first pair of opposed waveguide surfaces and a second pair of waveguide surfaces. The first horn angle is defined as the convergence angle between the first pair of opposed surfaces. The second horn angle is defined as the convergence angle between the second pair of opposed surfaces.

In a preferred embodiment, the acoustic radiator assembly may comprise a plurality of individually driveable diaphragm elements, each having a rigid, acoustically radiating surface, the diaphragm elements being arranged such that their acoustically radiating surfaces together form said section from a toroidal surface.

In embodiments of the invention, the acoustic radiator assembly may further comprise a phase plug mounted in front of the diaphragm. In one embodiment, the phase plug has characteristics matched to those of the acoustically radiating surface of the diaphragm so as to maintain the shape of the wavefronts generated by the diaphragm. This type of phase plug is beneficial in that it constrains the air on which the diaphragm acts and thus increases the efficiency of the radiation/coupling. In another embodiment, the phase plug has characteristics mismatched to those of the diaphragm so as to cause dispersion of the wavefronts generated at the diaphragm as they pass through the phase plug. This type of phase plug can be used to extend the radiating angle of an acoustic radiator assembly beyond that which a said diaphragm can operate acceptably.

According to a second aspect of the invention, the present invention may provide an acoustic radiator assembly for a loudspeaker comprising a plurality of individually driveable diaphragm elements, each having a rigid, acoustically radiating surface, the diaphragm elements being arranged such that their acoustically radiating surfaces together form a section from a toroidal surface.

This multi-element diaphragm structure permits loudspeakers having a large acoustically radiating surface to be properly driven. In addition, the acoustically radiating surface, when driven, provides a good approximation to an ideal pulsating surface.

In the context of the present invention, the term "toroidal" should be construed broadly so as to encompass the case where the first curvature becomes very low compared with the second curvature or, in the limiting case, has zero curvature. Accordingly, a toroidal section within the meaning of the present invention also covers a cylinder-shaped section.

BRIEF DESCRIPTION OF THE DRAWINGS

Exemplary embodiments of the invention are hereinafter described with reference to the accompanying drawings, in which:

FIG. 6(*b*) shows a section view of FIG. 6(*a*) along the B-B axis;

FIG. 7(*a*) shows a loudspeaker in accordance with an embodiment of the invention including a second phase plug;

FIG. 7(*b*) shows a section view of FIG. 7(*a*) along the A-A axis; and

DETAILED DESCRIPTION OF ILLUSTRATIVE EMBODIMENTS

Figure 1:
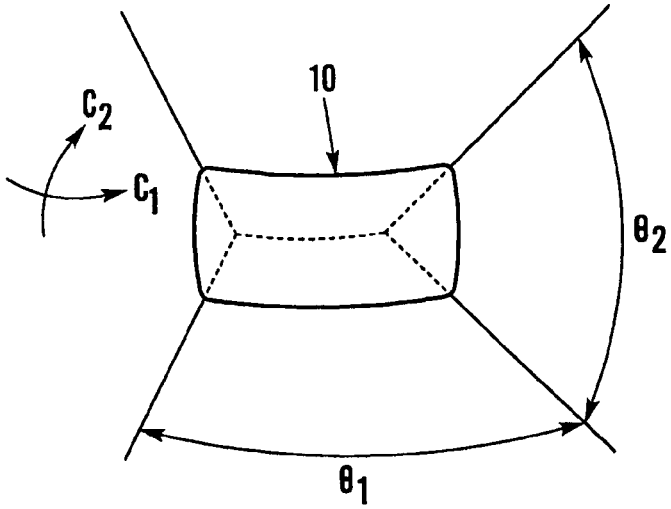
FIG. 1 shows the surface of a toroidal section.

FIG. 1 shows a representation of a surface 10 of a toroidal section illustrating its key geometric parameters. The torus from which the toroidal section is cut is a surface of revolution generated by revolving a circle in three dimensions about an axis co-planar with the circle. The surface 10 of the toroidal section has two defining curvatures, a first curvature $C_1$ in a plane perpendicular to the axis of rotation of the torus and a second curvature $C_2$ in a second plane co-planar with the axis of rotation. The surface of the toroidal section 10 has also two defining angles, a first section angle $\theta_1$, which defines the angular portion of the torus in a plane perpendicular to the axis of rotation of the torus which has been cut from the torus, and a second section angle $\theta_2$ which defines the angular portion of the torus in a second plane co-planar with the axis of rotation which has been cut from the torus. Referring to the drawings, a loudspeaker in accordance with an embodiment of the invention is generally designated 20. The loudspeaker 20 comprises an acoustic radiator assembly 22 comprising a multi-element, acoustically radiating diaphragm 25 having an acoustically radiating surface 27 which has the overall shape of a surface of a section from a toroidal surface. As can be seen by inspection of FIG. 2, which is a horizontal cross-sectional view of the loudspeaker 20, and FIG. 3 which is a vertical cross-sectional view of the loudspeaker 20, the diaphragm 25 comprises a 1×4 array of diaphragm elements 25*a-d*. Each diaphragm element 25*a-d* has a rigid, acoustically radiating surface 27*a-d* with the shape of a section from a toroidal surface having, in the terminology used in relation to FIG. 1, a first curvature $C_V$ and a first section or radiating angle $\theta_1$=24° as visible in FIG. 3, and a second curvature $C_H$ and a second section or radiating angle $\theta_2$=85° as visible in FIG. 2.

Figure 2:
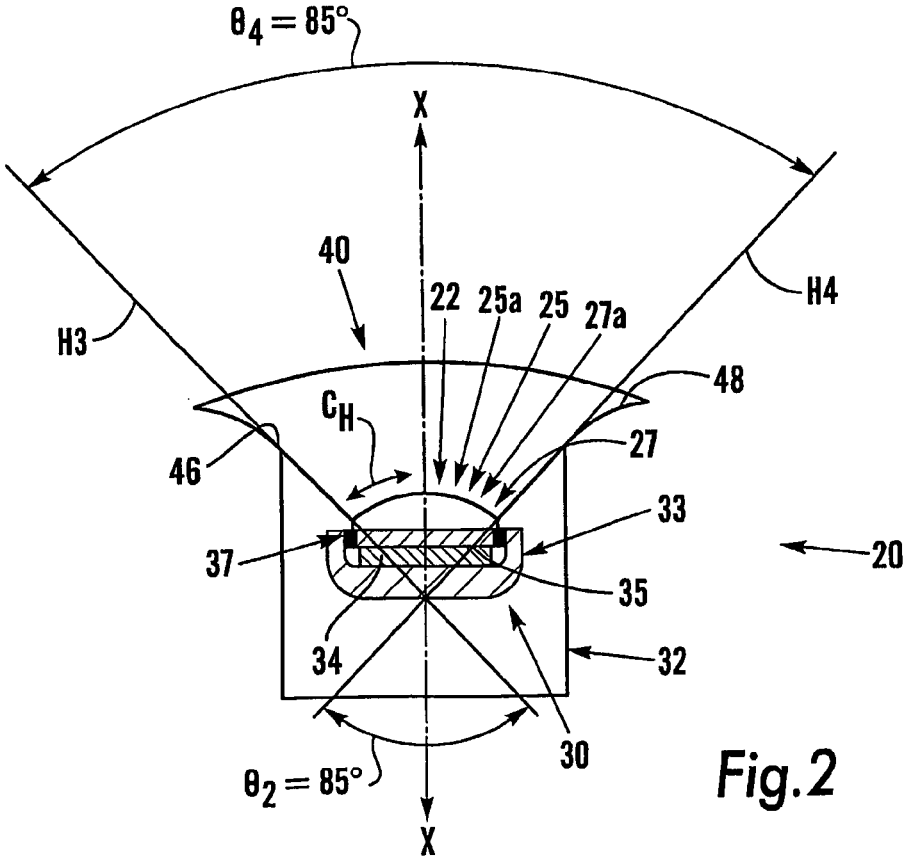
FIG. 2 shows a horizontal cross-sectional view through a loudspeaker in accordance with an embodiment of the invention.

It will be appreciated that the first and second curvatures of the acoustic radiating surface 27 of the diaphragm 25, as a whole is the same as that of the individual diaphragm elements 25*a-d*. Likewise, the acoustic radiating surface 27 of the diaphragm 25 being only one element wide has the same second section or radiating angle as a single element 25*a-d*, namely $\theta_2$=85°. However, in the vertical direction, there are 4 diaphragm elements, whereby the first section or radiating angle of the acoustic radiating surface of the diaphragm 25 as a whole is 4 times that of an individual element 25*a-d*, namely $\theta_1$=96°. Thus, in the illustrated embodiment, the diaphragm 25 is segmented in only the vertical direction. In other embodiments, the diaphragm may be additionally or alternatively segmented in the horizontal direction. As used herein, 'horizontal' and 'vertical' are only used as a shorthand frame of reference to refer to the directions in which the radiating surface 27 extends in a direction corresponding to each of $C_1$ and $C_2$ respectively in the FIG. 1 terminology and has no further special significance in the practice of the invention. Each diaphragm element 25*a-d* is individually driven by separate driver units 30 and its own associated enclosure 32 within which the driver unit 30 is located. Referring to FIG. 2, the driver unit 30 comprises a yoke 33, a magnet 34, a support member 35 rigidly coupled to the diaphragm element 25*a* and a voice coil 37 wound around the support member 35. The driver unit 30 is constructed, as is known in the art, such that when a driver current is applied to the voice coil 37, the coil 37 and the magnet 34 interact magnetically generating a force which causes movement of the support member 35 and consequently the diaphragm element 25*a* back and forth along the central axis X.

Figure 3:
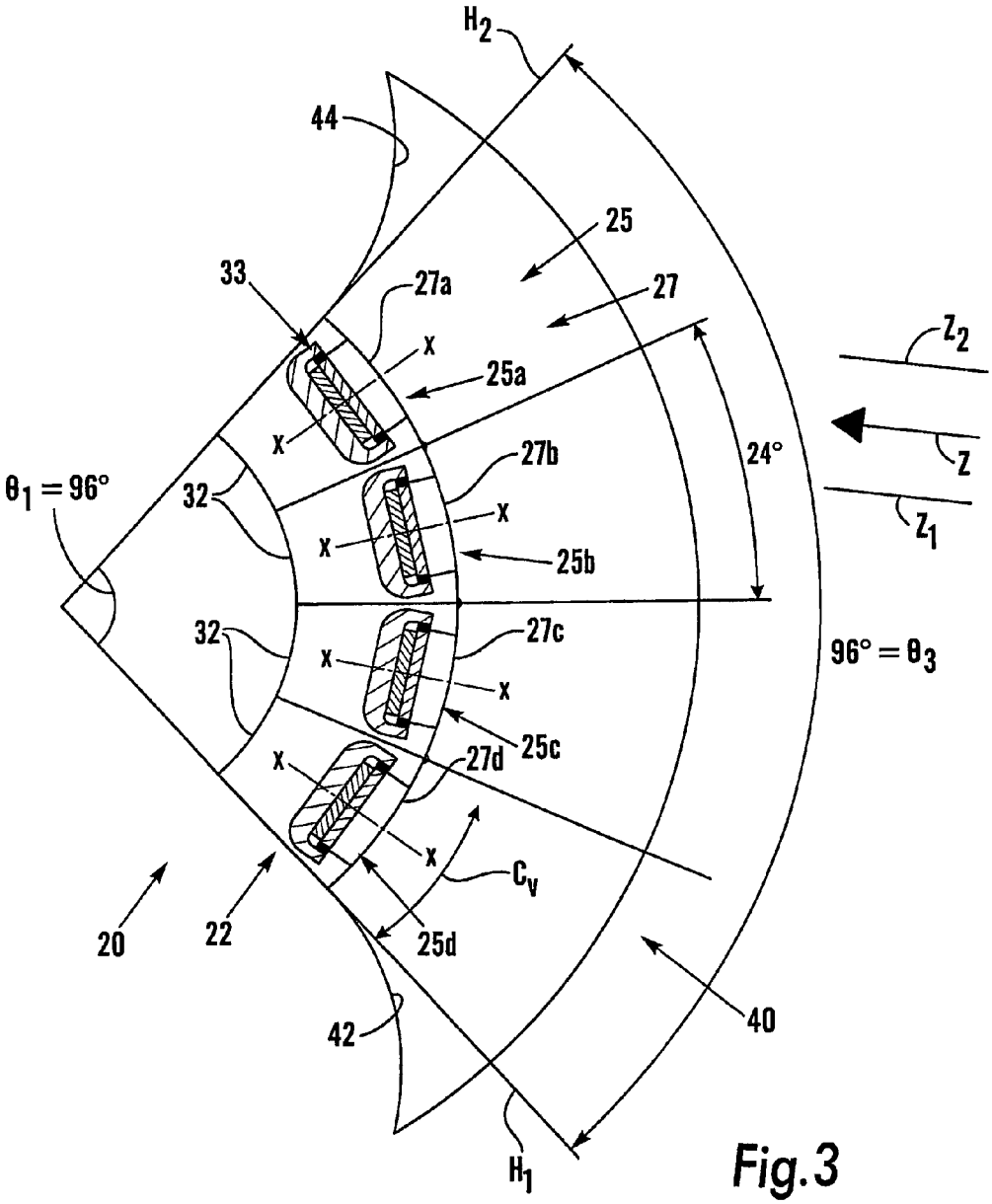
FIG. 3 shows a vertical cross-sectional view through a loudspeaker in accordance with an embodiment of the invention.

The loudspeaker 20 further comprises a dual angle horn waveguide 40 which is arranged such that the array of diaphragm elements 25*a-d* occupy the throat region of the horn 40 and has inner waveguide surfaces which are generally flared and shaped to match the wavefronts generated by the diaphragm element 25*a-d* as described below. The horn 40 has a pair of opposed and generally horizontal waveguide surfaces 42, 44 as seen in FIG. 3 and a pair of opposed and generally vertical waveguide surfaces 46, 48. A first, vertical horn angle of $\theta_3$ is defined as the convergence angle of the two generally horizontal waveguide surfaces 42, 44. In FIG. 3, $\theta_3$=96°. A second, horizontal horn angle of $\theta_4$ is defined as the convergence angle of the two generally vertical waveguide surfaces 46, 48. In FIG. 2, $\theta_4$=85°. It will be appreciated that, in the above-described embodiment, the horizontal and vertical radiating angles $\theta_1$, $\theta_2$ of the diaphragm 25 are the same as the horizontal and vertical horn angles $\theta_3$, $\theta_4$.

In use, when a signal is supplied to the loudspeaker 20, each of the driver units individually receives the signal at its respective voice coil 37 and responsive to that signal, the respective diaphragm elements 25*a-d* moves back and forth along the central axis X of its respective driver unit as described above. The motion of each diaphragm element is mechanically independent of the other diaphragm elements, but because of the relative orientation of the driver units and the fact that each is being driven by the same signal, the co-ordinated movement of diaphragm elements 25*a-d* and the overall shape of the surface which they together present to the air creates wavefronts having a curvature $C_H$ in the horizontal direction and a curvature $C_V$ in the vertical direction.

Figure 8:
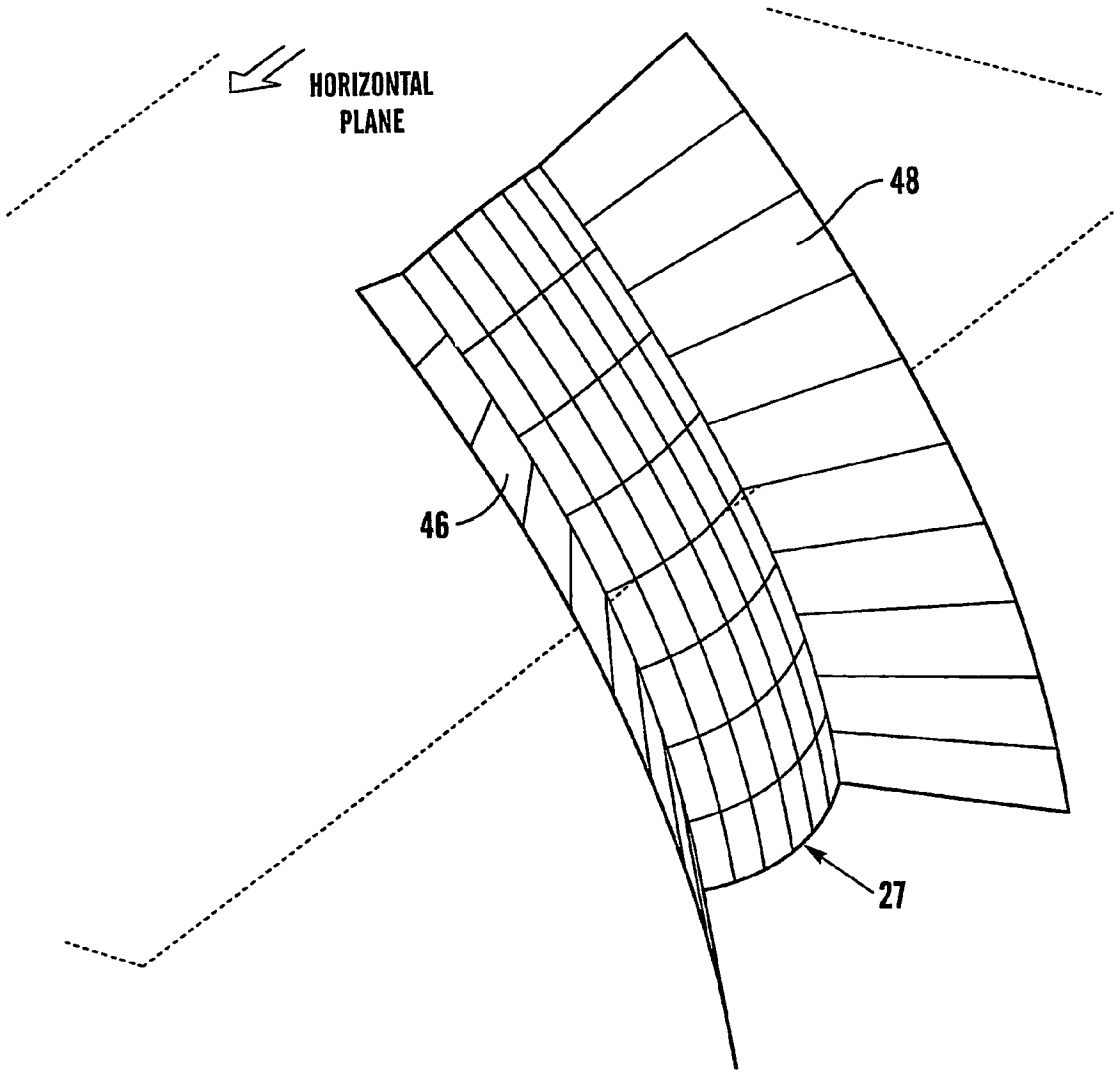
FIG. 8 shows a three dimensional view of a portion of FIG. 3 looking from the perspective of arrow Z.

The shape of the horn's waveguide surfaces 42, 44, 46, 48 having been selected to match the shape of wavefronts coming from the acoustic radiator assembly 22, which in this embodiment equates to that determined by the geometry of the acoustically radiating surface 27, does not disrupt the regularity of the radiation pattern and so serves to keep the wavefront generated in practice a close approximation to the theoretical expectation. Nominally, matching occurs if the angle between the direction of travel of the wavefront as it comes from the acoustic radiator assembly 22 and a tangent to a nearby portion of the waveguide surface is approximately 90°. The required geometry of the waveguide surfaces 42, 44, 46, 48 can be readily appreciated from FIG. 8 which shows a horizontal slice of FIG. 3 between lines $Z_1$ and $Z_2$ in a three dimensional view looking generally from the perspective of arrow Z. The lines shown on the radiating surface 27 and the vertical waveguide surfaces 46, 48 are for diagrammatic purposes to show curvature and do not denote segmentation of the surfaces.

Figure 4:
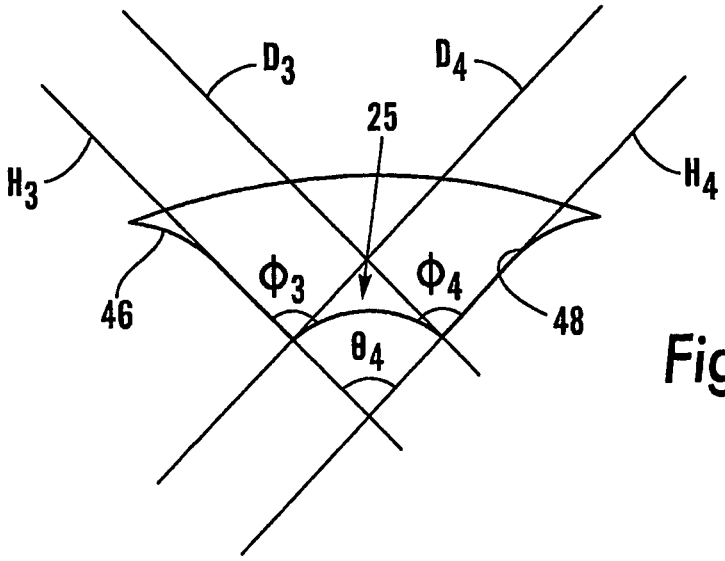
FIG. 4 shows the view of FIG. 2 with various details removed to illustrate the disposition of the horn and the diaphragm.
Figure 5:
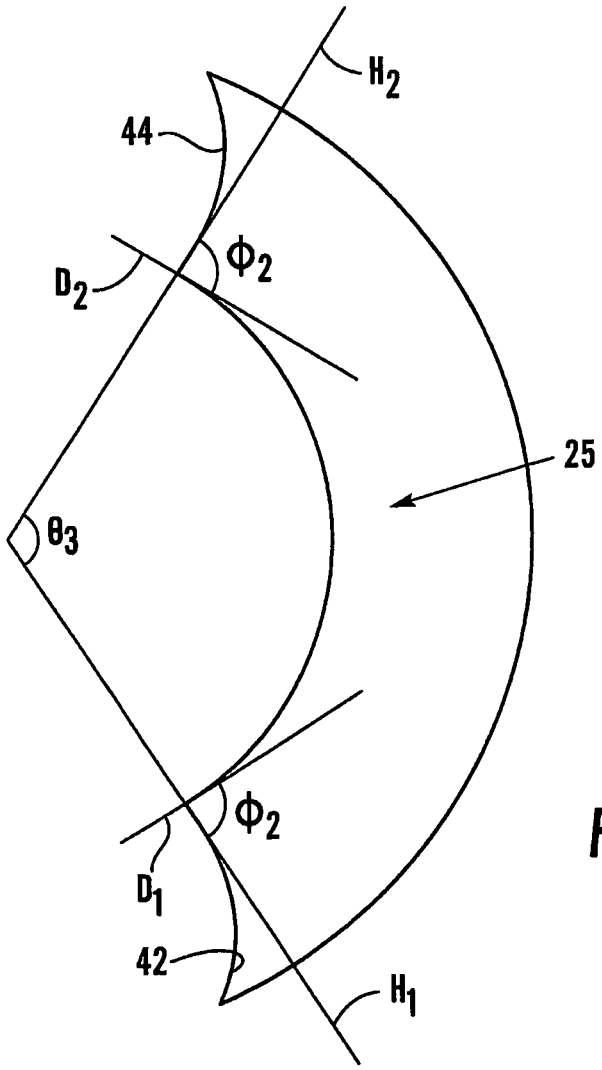
FIG. 5 shows the view of FIG. 3 with various details removed to illustrate the disposition of the horn and the diaphragm.

FIGS. 4 and 5 show views corresponding to those in FIGS. 2 and 3 with various parts omitted with the aim of showing the relative disposition of the horn's waveguide surfaces 42, 44, 46, 48 and the acoustically radiating surface 27.

Referring to FIG. 4, surfaces $D_3$ and $D_4$ represent surfaces which are tangential extrapolations of the diaphragm surface 27 and $H_3$ and $H_4$ represent surfaces which are tangential extrapolations of the vertical waveguide surfaces 46, 48 at points where the diaphragm surface 27 meets the generally vertical waveguide surfaces 46,48. The angle subtended between surfaces $D_3$ and $H_3$ at these points is denoted $Ø_3$. The angle subtended between surfaces $D_4$ and $H_4$ is denoted $Ø_4$. It is preferred that $Ø_3$ and $Ø_4$ are equal, but in some embodiments, they could be different. Good matching is achieved, in practice, when for a second, horizontal horn angle $\theta_4$ between 40° and 80°, $Ø_3$ and $Ø_4$ are greater than 85°; for an angle $\theta_4$ between 80° and 100°, $Ø_3$ and $Ø_4$ are between 85° and 90°; and for an angle $\theta_4$ between 100° and 120°, $Ø_3$ and $Ø_4$ are between 100° to 110°.

Referring to FIG. 5, surfaces $D_1$ and $D_2$ represent surfaces which are tangential extrapolations of the diaphragm surface 27 and $H_1$ and $H_2$ represent surfaces which are tangential extrapolations of the horizontal waveguide surfaces 42, 44 at points where the diaphragm surface 27 meets the generally horizontal waveguide surfaces 42, 44. The angle subtended between surfaces $D_1$ and $H_1$ is denoted Ø2. It is preferred that $Ø_1$ and $Ø_2$ are equal, but in some embodiments, they could be different. Good matching is certainly achieved, when for a first horizontal horn angle of θ3 between 40° and 80°, $Ø_1$ and $Ø_2$ are greater than 85°; for an angle $\theta_3$ between 80° and 100°, $Ø_1$ and $Ø_2$ are between 85° and 90°; and for an angle $\theta_3$ between 100° and 120°, $\theta_1$ and $\theta_2$ are between 100° to 110°. However, in practice, because the diaphragm surface is segmented in the embodiment shown in the vertical direction, a far larger radiating angle $\theta_1$ and a correspondingly large horn angle $\theta_3$ are made possible.

In other embodiments (not shown), the acoustic radiator assembly 22 may comprise a single diaphragm. However, because of the difficulties of properly driving a large diaphragm, this is not a preferred arrangement. Accordingly, for many applications, the multi-element diaphragm construction, as shown in the drawings, is preferred. In other embodiments, arrays consisting of a larger number of diaphragm elements may be used. Since each diaphragm element is of a modest size, relative to its own driver unit, large loudspeaker structures may readily be constructed. It will be noted that by using a multi-element diaphragm and mounting the diaphragm elements in an arrangement in which the axis along which their respective acoustically radiating surfaces move, during use, are not parallel to one another, but rather perpendicular to the face of the overall acoustically radiating surface of which they form a part, the structure more closely approximates the idealised pulsating surface which is often assumed in design simulations.

In other embodiments, the acoustic radiator assembly 22 may further comprise a phase plug mounted in front of the diaphragm.

Figure 6A:
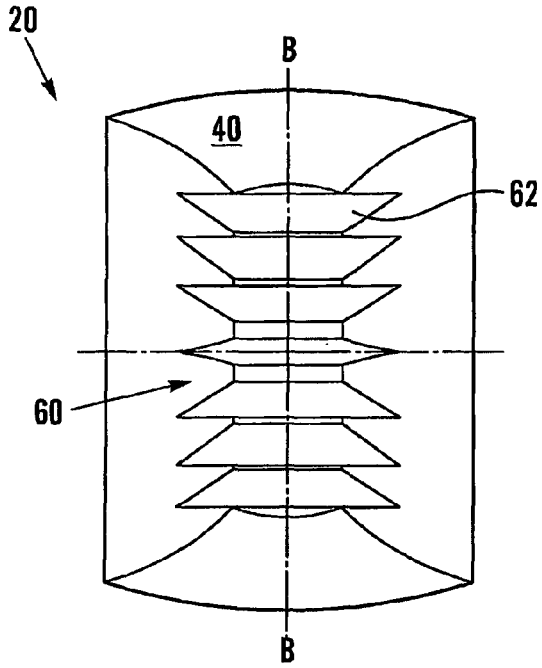
FIG. 6(*a*) shows a loudspeaker in accordance with an embodiment of the invention including a first phase plug.
Figure 6B:
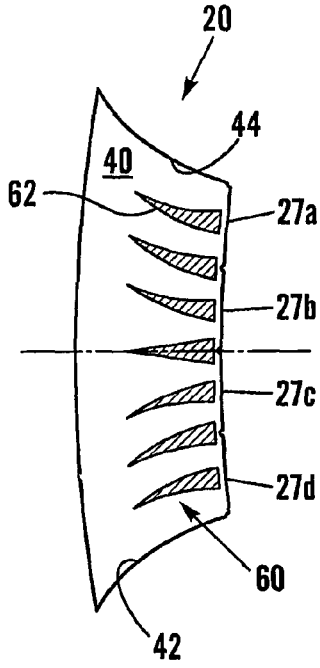

FIGS. 6(*a*) and (6) show a first phase plug 60 having baffles 62. Referring to the sectional view of FIG. 6(*b*) especially, it can be seen that the baffles 62 have been shaped to extend substantially along the direction of travel of wavefronts generated at the diaphragm element surfaces 27*a-d* (or collectively referred to as the diaphragm surface 27) and so to minimally interfere with, or distort, the shape of the wavefronts generated at the diaphragm surface 27. Thus, in this embodiment, the main purpose of the phase plug 60 is to constrain the air on which the diaphragm acts and thus increase the efficiency of the acoustic radiation/coupling.

FIGS. 7(*a*) and 7(*b*) show a second phase plus 70 having baffles 72 and a toroidal outlet. The toroidal outlet is only positively illustrated by a dotted line in the sectional view in FIG. 7(*a*) where it is labelled 74.

The design of the phase plug 70 differs from that of the phase plug 60 in two key respects. First, in the nomenclature of FIG. 1, the outlet has first and second section angles which are larger than those of the diaphragm radiating surface 27. This is illustrated in the horizontal sectional view of FIG. 7(*b*). The outlet has a first section angle [alpha] i.e. the angle subtended between plane $P_1$ and $P_2$. Whereas, the horizontal radiating angle $\theta_2$ of the diaphragm radiating surface 27 is smaller than α. This allows the acoustic radiation generated at the diaphragm radiating surface 27 to disperse as it travels through the phase plug 70. Second, the shape of the slots between the baffles 72 are selected such that the path length from the diaphragm radiating surface 27 to the outlet of the phase plug is kept constant. As a result of these features, wavefronts which approximate those produced by an idealised toroidal surface can be produced at horizontal radiating angles larger than those which an axially driven toroidal multi-segment diaphragm can be made to produce. By applying similar measures in the orthogonal vertical direction, the vertical radiating angle can be similarly extended, although, in the case shown, this would often not be needed because the vertically segmented diaphragm 25 may already be expected to approximate a pulsating source in that direction.

It will be appreciated that, since the acoustic radiator assembly 22 comprises a phase plug 70 that allows the acoustic radiation pattern generated by the diaphragm radiating surface 27 to disperse as it passes through the phase plug 70 and is thus re-shaped by it, although the vertical and horizontal horn angles $\theta_3$, $\theta_4$ are again selected to match the wavefronts coming from the acoustic radiator assembly 22, in this embodiment including a phase plug 70, the matching must be determined with respect to the wavefronts as they exit the phase plug, rather than at the point of generation at the acoustically radiating surface 27 as per the FIGS. 2 and 3 embodiment which do not include a phase plug. However, as the wavefronts which are leaving the phase plug 70 are substantially similar to those which might be expected from a pulsating source, the radiating angles and the corresponding horn angles can be very large.

In other embodiments (not shown), as an alternative to the static waveguide described above, the waveguide 40 is adapted to serve as a further acoustically radiating diaphragm. This diaphragm would operate over a lower frequency range and so does not need to have a toroidal shape. In one embodiment, all or part of the waveguide surfaces 42-48 are driven. By using the waveguide actively in this way, the operative frequency range of the loudspeaker can be extended to embrace lower frequencies. The waveguide 40 can be driven either independently from or in concert with the diaphragm 25 according to need. Preferably, the waveguide is used to radiate acoustic energy in the bass region and serve as a coincident acoustic source with the diaphragm which is used to radiate higher frequency acoustic energy.

Although the present invention has been described with reference to preferred embodiments, workers skilled in the art will recognize that changes may be made in form and detail without departing from the spirit and scope of the invention.

The invention claimed is:

1. A loudspeaker comprising a horn waveguide having a throat and a waveguide surface; an acoustic radiator assembly, located at the throat of the waveguide, comprising a diaphragm having a rigid acoustically radiating surface, the entire acoustically radiating surface shaped as a section from a toroidal surface for generating acoustic wavefronts, the waveguide surface being adapted to match the shape of the wavefronts coming from the assembly.

2. The loudspeaker as in claim 1, wherein the section has a first section angle and a first curvature in a first plane perpendicular to the axis of rotation of a torus extrapolated from the toroidal surface and a second section angle and a second curvature in a second plane co-planar with said axis of rotation, wherein the first curvature and the second curvature differ.

3. The loudspeaker as in claim 2, wherein one of said first and second curvatures is zero.

4. The loudspeaker as in claim 1, wherein the waveguide surface is shaped such that the angle of travel of the wavefronts coming from the assembly and a tangent to a nearby portion of the waveguide surface is approximately 90°.

5. The loudspeaker as in claim 1, wherein the horn wave guide is dual angle comprising a first pair of opposed waveguide surfaces and a second pair of waveguide surface, the first horn angle being defined as the convergence angle between the first pair of opposed surfaces, and the second horn angle being defined as the convergence angle between the second pair of opposed surfaces.

6. The loudspeaker as in claim 1, wherein the acoustic radiator assembly comprises a plurality of individually driveable diaphragm elements, each having a rigid, acoustically radiating surface, the diaphragm elements being arranged such that their acoustically radiating surfaces together form said section from a toroidal surface.

7. The loudspeaker as in claim 1, further comprising a phase plug, mounted in front of the diaphragm, having characteristics matched to those of the acoustically radiating surface of the diaphragm so as to maintain the shape of the wavefronts generated by the diaphragm.

8. The loudspeaker as in claim 1, further comprising a phase plug, mounted in front of the diaphragm, having characteristics mismatched to those of the diaphragm so as to cause dispersion of the wavefronts generated at the diaphragm as they pass through the phase plug.

9. The loudspeaker as in claim 2, further comprising a phase plug, mounted in front of the diaphragm, having characteristics mismatched to those of the diaphragm so as to cause dispersion of the wavefronts generated at the diaphragm as they pass through the phase plug.

10. The loudspeaker as in claim 1, wherein the waveguide comprises a driven acoustically radiating diaphragm.

11. The loudspeaker as in claim 9, wherein the phase plug has an outlet shaped as a section from a toroidal surface and at least one of the said first and second section angles of the radiating surface of the diaphragm is less than the corresponding angle of the outlet.

12. The loudspeaker as in claim 3, wherein the waveguide surface is shaped such that the angle of travel of the wavefronts coming from the assembly and a tangent to a nearby portion of the waveguide surface is approximately 90°.

13. The loudspeaker as in claim 12, wherein the horn wave guide is dual angle comprising a first pair of opposed waveguide surfaces and a second pair of waveguide surface, the first horn angle being defined as the convergence angle between the first pair of opposed surfaces, and the second horn angle being defined as the convergence angle between the second pair of opposed surfaces.

14. The loudspeaker as in claim 13, wherein the acoustic radiator assembly comprises a plurality of individually driveable diaphragm elements, each having a rigid, acoustically radiating surface, the diaphragm elements being arranged such that their acoustically radiating surfaces together form said section from a toroidal surface.

15. The loudspeaker as in claim 14, further comprising a phase plug, mounted in front of the diaphragm, having characteristics matched to those of the acoustically radiating surface of the diaphragm so as to maintain the shape of the wavefronts generated by the diaphragm.

16. The loudspeaker as in claim 14, further comprising a phase plug, mounted in front of the diaphragm, having characteristics mismatched to those of the diaphragm so as to cause dispersion of the wavefronts generated at the diaphragm as they pass through the phase plug.

17. The loudspeaker as in claim 16, wherein the waveguide comprises a driven acoustically radiating diaphragm.

18. An acoustic radiator assembly for a loudspeaker comprising a plurality of individually driveable diaphragm elements, each having a rigid, acoustically radiating surface, the diaphragm elements being arranged such that all their acoustically radiating surfaces together form a section from a toroidal surface.

19. The acoustic radiator assembly as in claim 18, wherein the section has a first curvature in a plane perpendicular to the axis of rotation of a torus extrapolated from the toroidal surface and a second curvature in a second plane co-planar with said axis of rotation, wherein the first and second curvature differ.

20. The acoustic radiator assembly as in claim 19, wherein one of said first and second curvatures is zero.

* * * * *

UNITED STATES PATENT AND TRADEMARK OFFICE

CERTIFICATE OF CORRECTION

PATENT NO. : 8,479,873 B2
APPLICATION NO. : 12/670258
DATED : July 9, 2013
INVENTOR(S) : Mark Dodd It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 417 days.

Signed and Sealed this
Eighth Day of September, 2015

Michelle K. Lee

Michelle K. Lee
*Director of the United States Patent and Trademark Office*